US005460162A

United States Patent [19]

Binzer

[11] Patent Number: 5,460,162

[45] Date of Patent: Oct. 24, 1995

[54] FIREPLACE VENTILATION SYSTEM

[76] Inventor: Lothar Binzer, 5721 - 124th St., Surrey, B.C., Canada, V3X 3H3

[21] Appl. No.: 221,722

[22] Filed: Apr. 1, 1994

[51] Int. Cl.[6] ..... F24B 1/189

[52] U.S. Cl. ..... 126/517; 126/112; 126/85 B; 126/80; 126/312

[58] Field of Search ..... 126/85 B, 80, 126/77, 312, 316, 315, 500, 515, 517, 518, 526, 112

[56] References Cited

U.S. PATENT DOCUMENTS

| | | | |
|---|---|---|---|
| 3,552,377 | 1/1971 | Hodges . | |
| 3,802,491 | 4/1974 | Plank, Jr. et al. . | |
| 4,142,679 | 3/1979 | McKillop, Sr. . | |
| 4,262,608 | 4/1981 | Jackson . | |
| 4,270,513 | 6/1981 | Mitchelson . | |
| 4,545,360 | 10/1985 | Smith et al. | 126/80 X |
| 4,793,322 | 12/1988 | Shimek et al. | 126/80 |

*Primary Examiner*—Larry Jones
*Attorney, Agent, or Firm*—Townsend and Townsend and Crew

[57] ABSTRACT

Apparatus for ventilating a fireplace having a combustion chamber within the interior of a building comprising an enclosure defining an air volume and a fan unit for generating a constant negative pressure region within the enclosure. A venting passage communicates the enclosure with the combustion chamber of the fireplace such that the negative pressure within the enclosure draws combustion gases from the combustion chamber into the enclosure to ventilate the fireplace. A valve is provided in the venting passage to control the flow of combustion gases to the enclosure. With this arrangement, the fan unit is operated at a constant speed to generate a constant negative pressure within the enclosure. There is no need to install an expensive variable speed fan to provide different levels of ventilation and, as long as the fan installed is sufficiently powerful to ventilate the enclosure, the valve can be used to adjust the ventilation of the fireplace combustion chamber via the enclosure.

5 Claims, 1 Drawing Sheet

FIREPLACE VENTILATION SYSTEM

FIELD OF THE INVENTION

This invention relates to a ventilation system for a fireplace.

BACKGROUND OF THE INVENTION

Any fireplace positioned within the interior of a building requires some system for ventilating the combustion chamber of the fireplace where burning of fuel occurs. Generally, the combustion gases are collected and exhausted to the exterior of the building to avoid the gases accumulating in the interior of the building. Numerous ducting systems have been developed to collect and direct the combustion gases to the exterior of the building.

Some fireplace designs rely on the natural convection movement of heated air and combustion gases to establish and maintain a gas flow in the ducting system to the exterior of the building to properly ventilate the fireplace. In some cases, convection ventilation of a fireplace is not sufficient to permit safe and proper operation of a fireplace. In such cases, a fan unit is used to force increased air flow through the venting duct system to ensure appropriate ventilation.

There are, however, drawbacks to existing fireplace designs that used forced ventilation. When installing a fireplace, it is important that the fan unit be correctly sized to be able to force air through the length of vent duct system. On the other hand, the fan unit must not be so powerful as to over ventilate the combustion chamber such that heated interior air is drawn from the room through the combustion chamber and exhausted to the exterior resulting in heat loss and energy wastage. Fan units have to be sized to handle the largest conceivable ventilation flow rate for a fireplace depending on the rate of fuel combustion and therefore, there is a tendency for the fan units to over ventilate the combustion chamber leading to energy loss and wastage. Variable speed fan units can be installed to handle different ventilation rates but these units tend to be unreliable and expensive and add to the complexity of the fireplace unit.

SUMMARY OF THE INVENTION

In view of the foregoing, there is a need for a fireplace ventilation system that provides for forced ventilation of a fireplace combustion chamber without the problems of over ventilating.

The ventilation system of the present invention provides a system that will function under variable conditions to supply fresh air to and vent combustion gases from a fireplace without resorting to a variable speed fan unit.

The ventilation system of the present invention is also easily adaptable for use in a wide range of building sites. It is capable of ventilating a combustion chamber through ducting systems of various lengths and ducting systems that include a great number of corners or turns.

Accordingly, the present invention provides apparatus for ventilating a fireplace having a the combustion chamber in the interior of a building comprising:

an enclosure defining an air volume;

ventilating means for generating a negative pressure within the enclosure;

a venting passage communicating the enclosure with the combustion chamber of the fireplace such that the negative pressure within the enclosure draws combustion gases from the combustion chamber into the enclosure to ventilate the fireplace; and valve means in the venting passage to control the flow of combustion gases to the enclosure.

BRIEF DESCRIPTION OF THE DRAWINGS

Aspects of the present invention are illustrated, merely by way of example, in the accompanying Figures, in which.

DESCRIPTION OF THE PREFERRED EMBODIMENT

Figure 1:
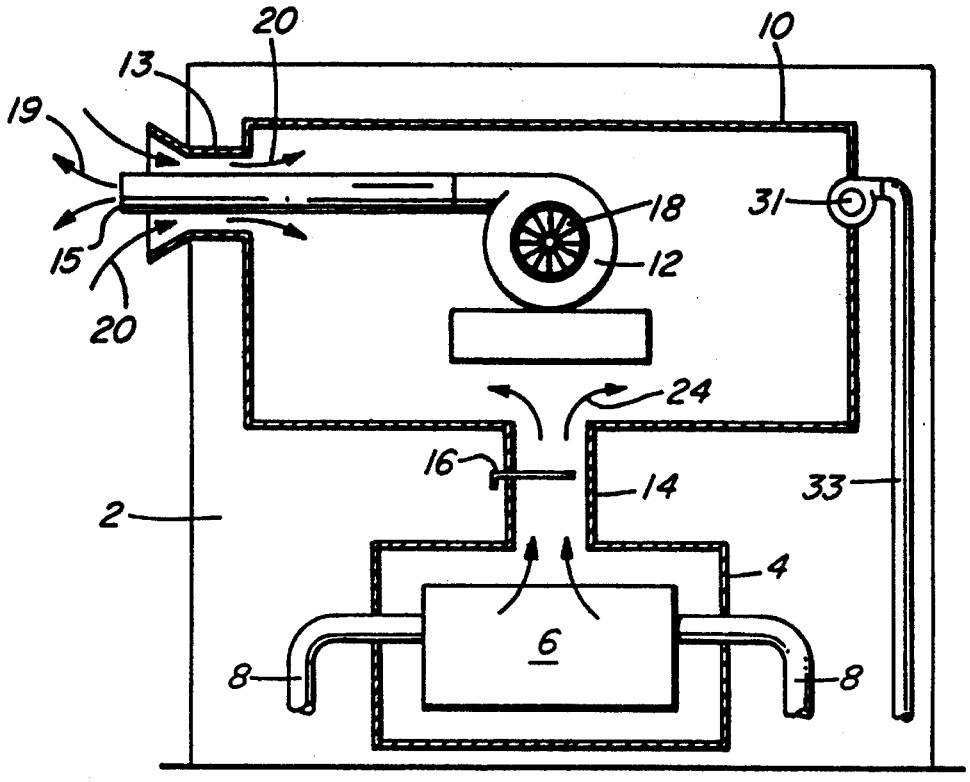
FIG. 1 is a schematic view of the apparatus of the present invention.

Referring to FIG. 1, there is schematically shown a room 2 in a building containing a fireplace 4 that incorporates a combustion chamber 6 for burning fuel to generate heat. The combustion chamber can be used to burn solid fuel such as wood or coal or gaseous fuel such as propane. The ventilation system according to the present invention is not limited to a fireplace that uses a particular type of fuel. Combustion chamber 6 includes inlets 8 for entrance of fresh air to the combustion chamber either directly from the interior of room 2 or from a ducting system (not shown) that brings in air from the exterior of the building.

The ventilating apparatus of the present invention includes an enclosure 10 defining an air volume and ventilating means comprising a fan unit 12 and inlet and outlet passages 13 and 15, respectively, to ventilate enclosure 10. A venting passage 14 communicates enclosure 10 with combustion chamber 6, and valve 16 within venting passage 14 is used to control the flow of combustion gases from combustion chamber 6 to enclosure 10. The elements of the present invention are mounted within the wall above and/or behind fireplace 4 and are not normally visible to a person within room 2. The finished face of fireplace 4 is all that is visible to a room occupant.

Enclosure 10 is a sealed sheet metal enclosure to define a fixed air volume. Fan unit 12 is mounted within enclosure 10 for generating a negative pressure within the enclosure. Air from enclosure 10 is drawn into inlet 18 of the fan unit and exhausted through outlet passage 15 as shown by arrows 19. The resulting negative pressure within enclosure 10 acts to draw exterior air into the enclosure through inlet passage 13 as shown by arrows 20. A steady state negative pressure is thereby created and maintained within enclosure 10 by fan unit 12. Enclosure 10 acts as a large reservoir of negative pressure that can be used to ventilate combustion chamber 6 by drawing heated combustion gases through venting passage 14 for mixing and exhausting with the air of enclosure 10. Enclosure 10 supplies fresh air as dilution air to cool hot combustion gases. Fan unit 12 is a preferably a single speed fan selected to maintain a constant negative pressure in enclosure 10. Therefore, fan unit 12 is sized according to the length of inlet and outlet passages it must force air through.

Preferably, inlet passage 13 and outlet passage 15 are arranged co-axially such that outlet passage 15 is positioned within inlet passage 13. Enclosure 10 receives heated combustion gases from combustion chamber 6 and also normal operation of fan unit 12 tends to heat the air within enclosure 10. Therefore, heated air that is exhausted through internal outlet passage 15 tends to pre-heat colder exterior air being brought in through inlet passage 13 so that enclosure 10 is filled with relatively warm air and does not require heating by fireplace 4 which would increase the fuel costs for operating the fireplace. In addition, enclosure 10 is well insulated to ensure energy efficiency.

Figure 2:
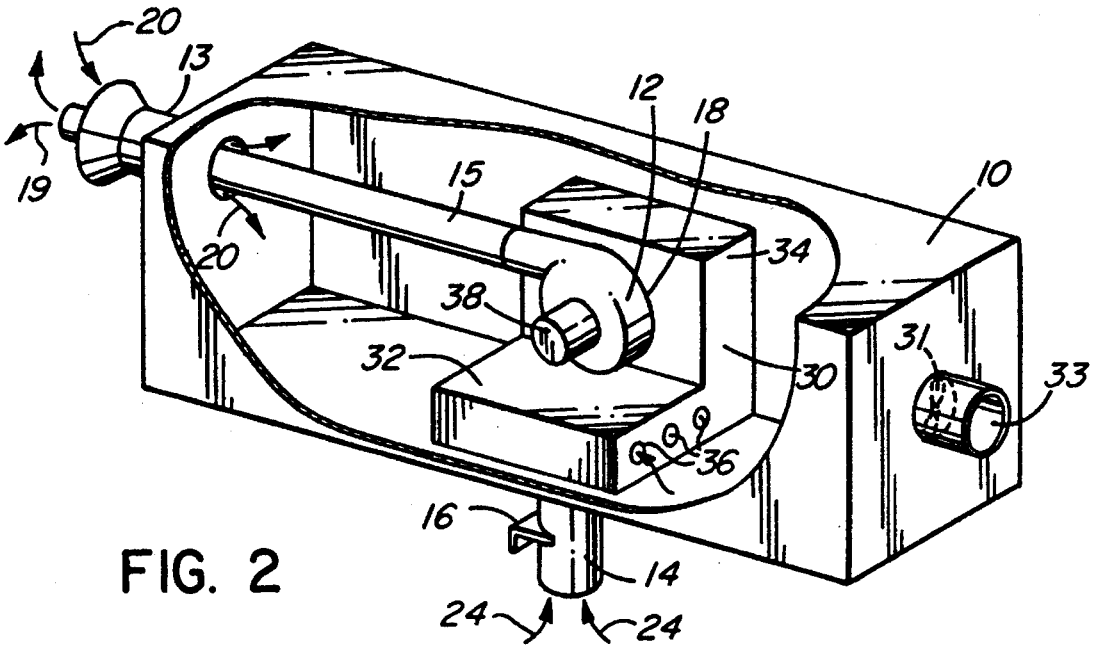
FIG. 2 is a detail view of a preferred embodiment of the present invention.

FIG. 2 provides a detail view of a preferred embodiment of the present invention in which fan unit 12 is fitted with a mixing manifold 30 to control mixing and distribution of air within enclosure 10. Mixing manifold 30 is a generally L-shaped sealed enclosure having a base portion 32 that is connected to venting passage 14 and an upright portion 34 that supports fan unit 12. Base portion 32 is formed with ports 36 that communicate the interior of the manifold with the interior of enclosure 10. Upright portion 34 is connected to inlet 18 of fan unit 12. Fan motor 38 extends from fan unit 12. Manifold 30 acts as a mounting site for fan unit 12 and provides a passage for combustion air from venting passage 14 directly to fan inlet 18. Ports 36 permit enclosure air to be mixed with combustion gases being exhausted from venting passage 14.

With enclosure 10 acting as constant reservoir of negative pressure and venting passage 14 communicating combustion chamber 6 with enclosure 10, combustion gases are drawn from combustion chamber 6 to enclosure 10 as indicated by arrows 24 to provide forced ventilation to the fireplace. Valve means in the form of a slidable plate 16 within the venting passage permits variation in the venting of the combustion chamber. Plate 16 varies the cross-sectional area of the venting passage available for flow of combustion gases and it can be set to adjust the appearance of the flame in the combustion chamber. The wider the valve is opened, the greater the ventilation of the combustion chamber and the larger and more mobile will be the flame in the combustion chamber. This variation in ventilation is achieved without varying the speed of fan unit 12.

It is also intended that the apparatus of the present invention can be fitted with an auxiliary fan unit 31 mounted in enclosure 10. Auxiliary fan 31 draws air from enclosure 10 for delivery to the room interior via duct 33 to replace air that is drawn into combustion chamber 6 thereby preventing a negative pressure developing in the interior of the building. This negative pressure can develop due to fresh air for combustion being drawn directly from the room or from leakage of room air into a sealed combustion chamber that is drawing fresh air from the exterior.

Although the present invention has been described in some detail by way of example for purposes of clarity and understanding, it will be apparent that certain changes and modifications may be practised within the scope of the appended claims.

I claim:

1. Apparatus for ventilating a fireplace having a combustion chamber in the interior of a building comprising:

an enclosure defining an air volume;

an inlet passage communicating the enclosure with the exterior of the building;

an outlet passage communicating the enclosure with the exterior of the building;

a fan unit operating at a pre-determined fixed speed for drawing exterior air in through the inlet passage into the enclosure and exhausting enclosure air and combustion gases through the outlet passage to the exterior of the building to maintain the enclosure at a substantially constant low pressure;

a venting passage communicating the enclosure with the combustion chamber of the fireplace such that the low pressure within the enclosure draws combustion gases from the combustion chamber into the enclosure to ventilate the fireplace, the low pressure being sufficient to ventilate the fireplace over all operating conditions of the fireplace; and valve means in the venting passage to control the flow of combustion gases to the enclosure.

2. Apparatus as claimed in claim 1 in which the inlet passage and the outlet passage are arranged coaxially, the outlet passage being positioned within the inlet passage and the outlet passage being connected to the exhaust of the fan unit.

3. Apparatus as claimed in claim 1 in which the valve means comprises a slidable plate within the venting passage to vary the cross-sectional area of the passage available for combustion gases flow.

4. Apparatus as claimed in claim 1 including an auxiliary fan unit associated with the enclosure to draw a supply of air from the enclosure for delivery to the interior to prevent a negative pressure developing in the interior.

5. Apparatus as claimed in claim 1 including manifold means defining a passage communicating the venting passage with the fan unit, the manifold means also including ports for communicating the manifold passage with the interior of the enclosure.

* * * * *